US006293550B1

(12) United States Patent
Zeitlin

(10) Patent No.: US 6,293,550 B1
(45) Date of Patent: Sep. 25, 2001

(54) MAGNETIC TIC-TAC-TOE ASSEMBLY

(76) Inventor: Lev Zeitlin, 1133 Broadway, Suite 1401, New York, NY (US) 10010

( * ) Notice: Subject to any disclaimer, the term of this patent is extended or adjusted under 35 U.S.C. 154(b) by 0 days.

(21) Appl. No.: 09/783,213

(22) Filed: Feb. 15, 2001

(51) Int. Cl.[7] ..... A63B 67/06
(52) U.S. Cl. ..... 273/271; 273/239
(58) Field of Search ..... 273/239, 271, 273/287, 283, 284, 282.1

(56) References Cited

U.S. PATENT DOCUMENTS

| | | | |
|---|---|---|---|
| D. 259,050 | | 4/1981 | Nadel . |
| 3,674,272 | | 7/1972 | Wazalek . |
| 3,768,809 | * | 10/1973 | Ciarfello . |
| 3,781,013 | | 12/1973 | Von Meyer . |
| 3,988,845 | | 11/1976 | Boatman . |
| 4,147,361 | | 4/1979 | Imatt . |
| 4,273,538 | | 6/1981 | Ross . |
| 4,361,822 | | 11/1982 | Adler . |
| 4,575,091 | | 3/1986 | Boomer . |
| 5,318,307 | * | 6/1994 | Bouchard et al. . |
| 5,433,448 | | 7/1995 | Raphael . |
| 5,609,319 | | 3/1997 | Kelley . |

FOREIGN PATENT DOCUMENTS

1114268 * 5/1968 (GB) .

* cited by examiner

*Primary Examiner*—William M. Pierce

(57) ABSTRACT

A magnetic version of the game "Tic-Tac-Toe" is disclosed. In the preferred mode, the game consists of twelve separate pieces die cut from a magnetic rubber sheet. Each set contains four elongated strips, intended to be arranged to create the tic-tac-toe board. In addition, the assembly includes four crosses (X's) and four circles (O's), each several inches in length and/or diameter. Importantly, the top surface of each game piece may be laminated with previously determined colors, patterns, text, or other graphics to enhance the appearance thereof. Thus, the present invention provides a complete game that may be adhered to any metallic surface, and used for entertainment, amusement, or decorative purposes.

13 Claims, 2 Drawing Sheets

MAGNETIC TIC-TAC-TOE ASSEMBLY

BACKGROUND OF THE INVENTION

1. Field of the Invention

The present invention is a magnetic version of the game "Tic-Tac-Toe." Specifically, in the preferred mode, the game consists of twelve separate pieces die cut from a magnetic rubber sheet. Each set contains four elongated strips, intended to be arranged to create the tic-tac-toe board. In addition, the assembly includes four crosses (X's) and four circles (O's), each several inches in length and/or diameter. Importantly, the top surface of each game piece may be laminated with previously determined colors, patterns, text, or other graphics to enhance the appearance thereof. Thus, the present invention provides a complete game that may be adhered to any metallic surface, and used for entertainment, amusement, or decorative purposes.

2. Description of the Prior Art

Many relevant innovations amusement devices are provided in the prior art, described as follows. Although these inventions are suitable for the purposes they address, they differ from the present invention as contrasted herein. Following is a summary of patents most relevant to the invention at hand, including description of differences between features of the invention and those of the prior art.

1. U.S. Pat. No. 3,781,013, invented by Von Meyer, entitled "Magnetic Tic-Tac-Toe Game"

The patent to Von Meyer describes a tic-tac-toe game in which the nine tic-tac-toe squares are represented by nine transparent compartments and the tic-tac-toe indicia are represented by magnetized discs having one color on one side and another color on the other side. Each compartment includes a transparent window and a pocket beneath and spaced from the window. Normally the colored magnetic discs are retained in pockets under transparent windows. The game is played by using magnetic wands having a color at one or both ends to match the colors of the magnetic discs, a disc being moved from its concealed position to a position under the window with the proper color corresponding to the color and polarity of the wand end being used.

2. U.S. Pat. No. 3,674,272 invented by Wazalek, entitled "Magnetic Board Game Apparatus"

In the patent to Wazalek, a game is disclosed including a transparent game board and magnetized playing pieces. The game board is mounted vertically for play with a tic-tac-toe design visible on the two opposite faces of the transparent board. Supports are provided on both board surfaces within the pattern to receive the magnetized pieces and winning and losing combinations of the pieces are arranged by the players on these supports with the players' skill plus a random choice of the magnetic polarity of the pieces as played determining the outcome of the game.

3. U.S. Pat. No. 5,433,448, invented by Raphael et al., entitled "Three-Dimensional Tic-Tac-Toe Game"

The patent to Raphael et al. describes a three-dimensional tic-tac-toe game which includes a lattice having cubicles for receiving X or O mating pieces therein. The pieces are held in the cubicles by Velcro patches on the pieces that cooperate with mating patches in the cubicles.

4. U.S. Pat. No. 4,147,361, invented by Imatt, entitled "Game Apparatus"

The patent to Imatt describes a game apparatus developed as a variation of a tic-tac-toe theme and employs a base having multiple sets of three-dimensional, diamond shaped matrices and two different types of playing pieces. Each playing piece has a pair of different symbols such as an "X" and "O" on an upper surface and the pieces are played by placement over pairs of playing spaces on the matrices. Each matrix may be color coded to distinguish from adjacent matrices. One type of playing piece is diamond shaped and is adapted for placement only within the boundaries of a single matrix. The other type of playing piece is angle shaped and is adapted for placement only across a boundary line between adjacent matrices. The "X" and "O" symbol of the playing piece is adapted to cover a pair of play spaces on the base. The player to complete the greatest number of rows of three of the same symbols wins the game.

5. U.S. Design Pat. No. 259,050, invented by Nadel, entitled "Pop-Up Tic-Tac-Toe Apparatus"

The design patent to Nadel shows an ornamental design for a pop-up tic-tac-toe apparatus.

6. U.S. Pat. No. 4,273,538, invented Ross, entitled "Educational Aid"

The patent to Ross describes an apparatus for teaching reading and comprises a book having lines of printed text and recordings of the text on associated magnetic strips and a pick-up member of sufficient weight to rest securely on the magnetic strips is provided with a tension member by which the pick-up member may be drawn manually or by a spring motor along the magnetic strips. The pick-up member may be shaped in a manner designed to appeal to the imagination of a user, for example as an animal.

7. U.S. Pat. No. 4,361,822, invented by Adler, entitled "Magnetic Pallet"

The patent to Adler describes a magnetic pallet incorporating a plurality of individual, flexible polymer magnetic strips in a double layer thickness between metallic front and back enclosure plates to provide a substantially continuous magnetic field across both front and back planar surfaces.

8. U.S. Pat. No. 5,609,319, invented by Kelley, entitled "Lotto Ticket Holder"

The patent to Kelley describes a card with magnetic strips on the back that mount the card on a metallic, vertical surface. The front of the card contains a bifurcated holder in the shape of a wish bone which is anchored at one end to the card. The central portion of the wish bone has a resilient band to hold the free end of the wish bone against the card. By slipping a lottery ticket between the free end of the wish bone and the card, a lottery ticket will be safely stored against loss.

9. U.S. Pat. No. 3,988,845, invented by Boatman, entitled "Sign Device Having Magnetic Display Characters"

The patent to Boatman describes a sign for displaying messages and includes a pair of dark backing boards supported within a frame. Thin flexible discs magnetically adhere to the boards to form words, letters, and other selected patterns thereon. The outer surfaces of the discs reflect light and/or are different in color than the backing boards in order to illustrate the displayed message.

10. U.S. Pat. No. 4,575,091, invented by Boomer, entitled "Word Game Of Magnetizable Letters For Children"

The patent to Boomer describes a word game for children comprising a plurality of magnetizable alphabet letters for throwing on a surface to form a pile, a magnet stiff wand having a handle for pulling desired letters from the pile, each letter having a body cut-out into the shape so that it can be recognized by sight, the body of each letter magnetizable so that, when any part thereof is touched by the wand, the letter can be pulled from the pile, and a plurality of cards for the players to draw respective control cards therefrom, each control card having intelligence printed thereon which requires each player to spell a word with the letters on the card he pulls from the pile, the wand and the pile of magnetizable letters challenging a player's dexterity in being able to sight a desired letter or letters in the pile and to manipulate the wand and to insert same into the pile to pull therefrom only the letter or letters desired and no other letters.

Although the above-listed patent to Von Meyer illustrates a tic-tac-toe assembly that includes magnets, such is a large, free-standing apparatus that features transparent compartments, magnetized discs, and a magnetized wand member for moving the game pieces. The additional patents that relate to a tic-tac-toe theme show mostly three-dimensional, large devices that do not utilize magnets.

In contrast to the above, the present invention is a magnetic version of the game "Tic-Tac-Toe." Consisting of separate pieces die cut from a magnetic rubber sheet, each set contains four elongated strips to create the tic-tac-toe board, four "X's" and four "O's." The invention forms a complete game that may be adhered to a metallic surface, for instant entertainment. In addition, the top of each piece may be colored or contain stylized graphics for aesthetic purposes.

SUMMARY OF THE INVENTION

As noted, the present invention is a magnetic version of the game "Tic-Tac-Toe." Specifically, in the preferred mode, the game consists of twelve separate pieces die cut from a magnetic rubber sheet. Each set contains four elongated strips, intended to be arranged to create the tic-tac-toe board. In addition, the assembly includes four crosses (X's) and four circles (O's), each several inches in length and/or diameter. Importantly, the top surface of each game piece may be laminated with previously determined colors, patterns, text, or other graphics to enhance the appearance thereof. Thus, the present invention provides a complete game that may be adhered to any metallic surface, and used for entertainment, amusement, or decorative purposes.

According to the foregoing, it is an object of the present invention to provide an entertaining device which may be used upon any metal surface.

It is also a goal of the invention to provide an amusement device that functions effectively without the usage of a separate game board component.

It is a goal of the invention to provide an amusement and ornamental assembly which may be manufactured in a variety of sizes.

It is a further goal of the present invention to provide an entertaining device that may bear various colors and patterns or indicia thereon, such indicia relating to a previously determined theme or style.

It is a further goal of the present invention to provide an amusement device that is constructed of an inexpensive, lightweight material.

Finally, it is an aim of the present invention to provide an entertaining device that may be manufactured with relative ease.

In total, the novel features considered characteristic for the invention are set forth in the claims. The invention itself both as to its construction and method of operation, will be best understood from the following description of the embodiments when read and understood in connection with the drawings provided.

BRIEF DESCRIPTION OF PREFERRED EMBODIMENTS

DETAILED DESCRIPTION OF THE PREFERRED EMBODIMENT

Figure 1:
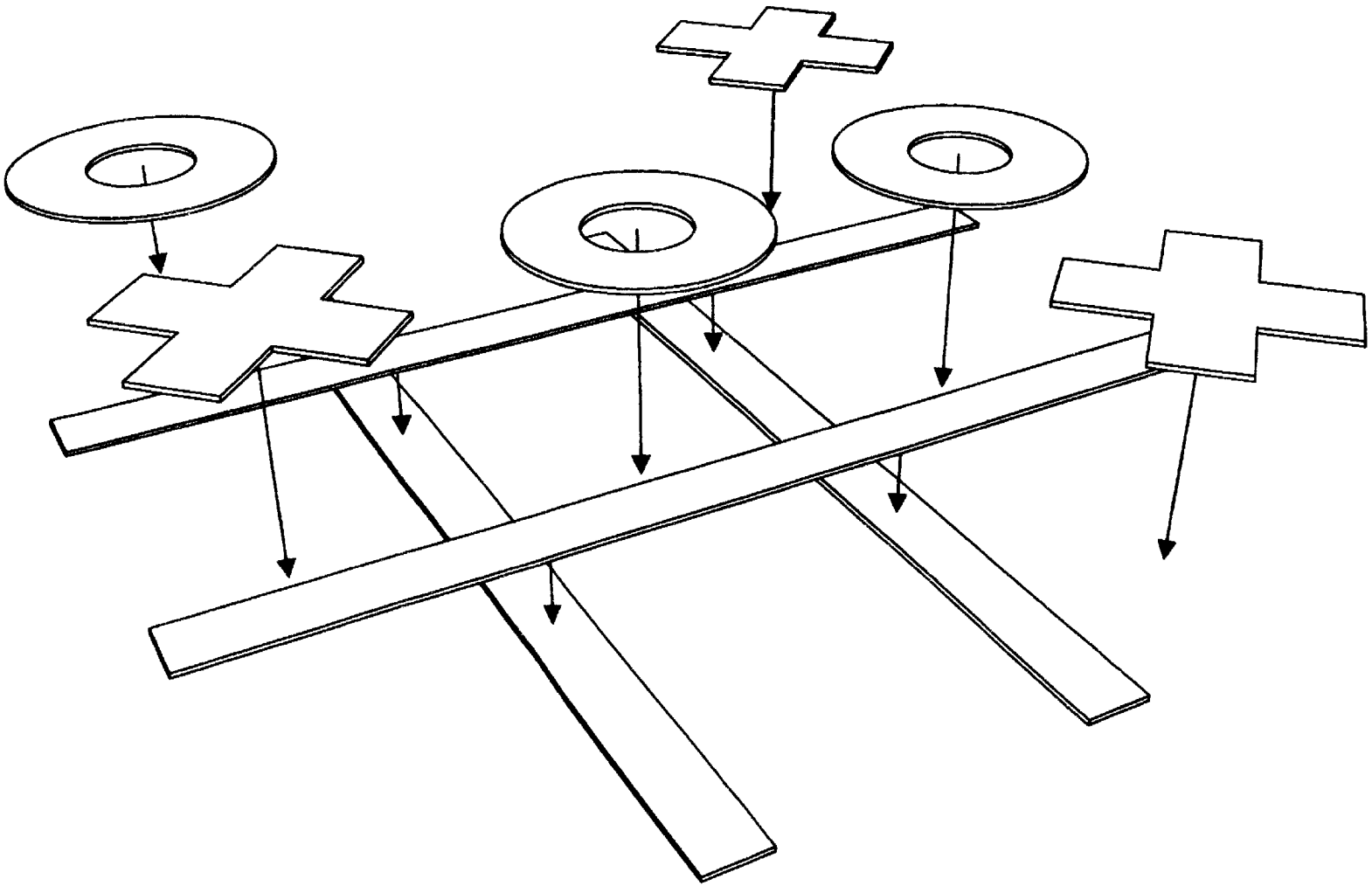
FIG. 1 is a three-quarter perspective view of the magnetic tic-tac-toe assembly, illustrating the three-dimensional, tactile nature of the game of the present invention.
Figure 2:
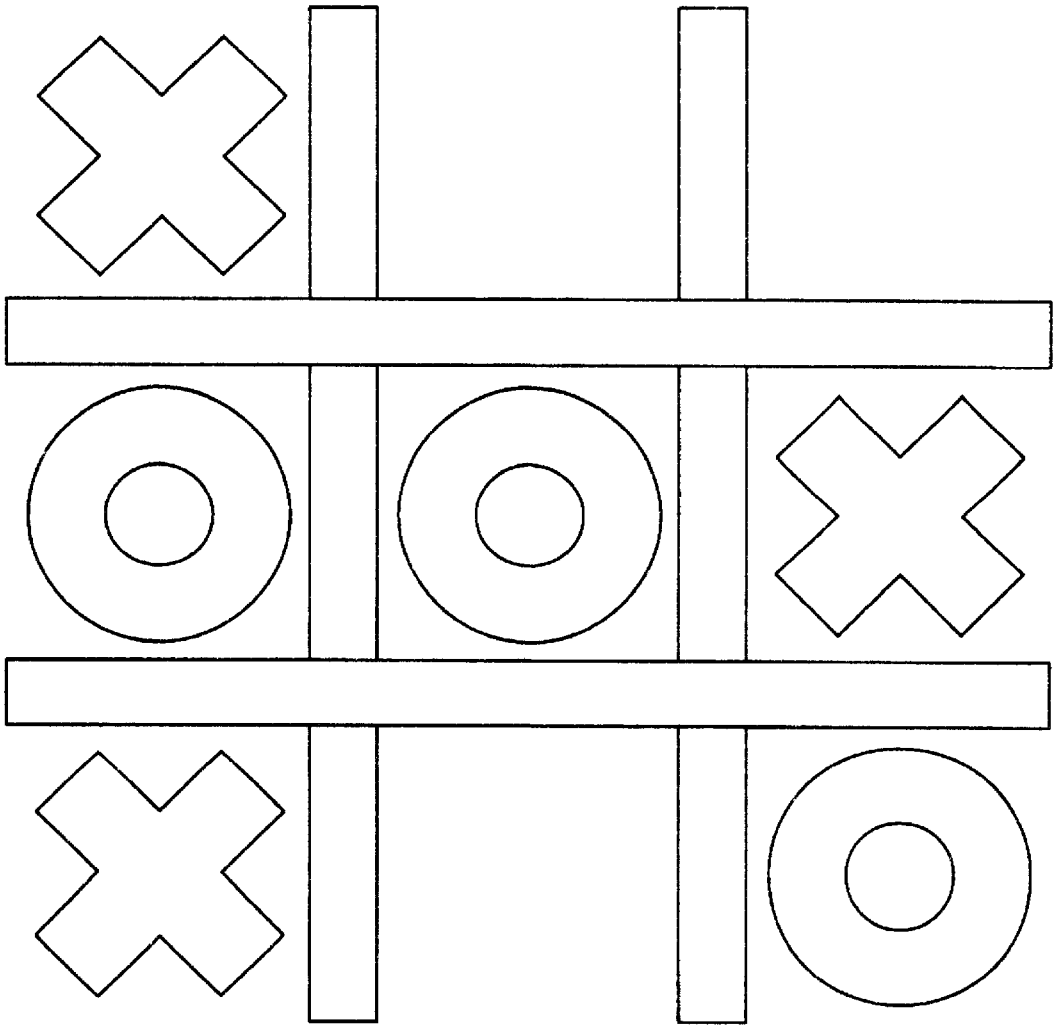
FIG. 2 is a plan view of the magnetic tic-tac-toe assembly, illustrating the "X" and "O" members as placed within the elongated pliable members during the game.

The following description relates to both FIG. 1, which is a three-quarter perspective view of the magnetic tic-tac-toe assembly, illustrating the three-dimensional, tactile nature of the game of the present invention; and FIG. 2, which is a plan view of the magnetic tic-tac-toe assembly, illustrating the "X" and "O" members as placed within the elongated pliable members during the game.

A magnetic tic-tac-toe game assembly is intended to be placed upon a metal surface. The assembly comprises four elongated pliable members, each of which is generally rectangular in nature. Each comprises a magnetic strip rigidly affixed thereto along a rear surface thereof.

The assembly further comprises four pliable members of a general shape of a letter "X," each also comprising a magnetic strip rigidly affixed thereto along a rear surface thereof, and four pliable members of a general shape of a letter "O," each also comprising a magnetic strip rigidly affixed thereto along a rear surface thereof.

Two of the elongated pliable members are intended to be aligned parallel to one another in a vertical orientation. In addition, the two remaining elongated pliable members are intended to be aligned parallel to one another in a horizontal orientation. Such horizontal members are placed upon and overlapping the two elongated pliable members of the vertical orientation. This is such that the four elongated pliable members form a grid in which users can place the "X" and "O" members for the purposes of playing a tic-tac-toe game upon a metallic surface.

In the preferred mode, the four elongated pliable members, four "X" members, and four "O" members are die cut from a magnetic rubber sheet.

Moreover, the top surface of the four elongated pliable members, four "X" members, and four "O" members may all be laminated.

In addition, the top surface of the four elongated pliable members, four "X" members, and four "O" members may all be painted.

Furthermore, the top surface of the four elongated pliable members, four "X" members, and four "O" members bear indicia thereon. Such graphics may be in the form of text, simple colors, or more complex patterns for identification purposes or user enjoyment.

In addition, the assembly may include a carrying case for containing the four elongated pliable members, four "X" members, and four "O" members.

In an alternate mode, the four elongated pliable members may be rigidly affixed to one another to form a single grid-like component.

In still another alternate mode, the assembly may include a flat magnetic sheet which functions as a game board. This flat sheet will function to allow users to place the "X" members and "O" members thereon for the purpose of playing the magnetic tic-tac-toe game.

Regarding preferred sizes of the principal components, the "O" members may be manufactured in the size of three inches in diameter. Also, the "O" members each comprise a hole that may be manufactured in the size of one and one-quarter inch in diameter. The "X" members of the present invention may be manufactured in the size of three inches in width and three inches in length. Moreover, the elongated pliable members may be twelve inches in length. Finally, the elongated pliable members, "X" members, and "O" members may be constructed as one thirty-second inch in thickness.

While the invention has been described as embodied, it is not intended to be limited to the details shown, since it will be understood that various omissions, modifications, substitutions and changes in the forms and details of the device illustrated and in its operation can be made by those skilled in the art without departing in any way from the spirit of the invention.

Without further analysis, the foregoing will so fully reveal the gist of the present invention that others can readily adapt it for various applications without omitting features that, from the standpoint of prior art, constitute essential characteristics of the generic or specific aspects of this invention. What is claimed as new and desired to be protected by Letters Patent is set forth in the appended claims.

I claim:

1. A magnetic tic-tac-toe game assembly, intended to be placed upon a metal surface, the assembly comprising:

four elongated pliable members, each generally rectangular in nature, each comprising a magnetic strip rigidly affixed thereto along a rear surface thereof;

four pliable members of a general shape of a letter "X," each comprising a magnetic strip rigidly affixed thereto along a rear surface thereof;

four pliable members of a general shape of a letter "O," each comprising a magnetic strip rigidly affixed thereto along a rear surface thereof;

two of the elongated pliable members aligned parallel to one another in a vertical orientation;

two remaining elongated pliable members aligned parallel to one another in a horizontal orientation, placed upon and overlapping the two elongated pliable members of the vertical orientation, such that the four elongated pliable members form a grid in which users can place the "X" and "O" members for the purposes of playing a tic-tac-toe game upon a metallic surface.

2. The magnetic tic-tac-toe game assembly as described in claim 1, wherein the four elongated pliable members, four "X" members, and four "O" members are die cut from a magnetic rubber sheet.

3. The magnetic tic-tac-toe game assembly as described in claim 1, wherein the top surface of the four elongated pliable members, four "X" members, and four "O" members are laminated.

4. The magnetic tic-tac-toe game assembly as described in claim 1, wherein the top surface of the four elongated pliable members, four "X" members, and four "O" members are painted.

5. The magnetic tic-tac-toe game assembly as described in claim 1, wherein the top surface of the four elongated pliable members, four "X" members, and four "O" members bear indicia thereon.

6. The magnetic tic-tac-toe game assembly as described in claim 1, wherein the assembly includes a carrying case for containing the four elongated pliable members, four "X" members, and four "O" members.

7. The magnetic tic-tac-toe game assembly as described in claim 1, wherein the four elongated pliable members are affixed to one another to form a single grid-like component.

8. The magnetic tic-tac-toe game assembly as described in claim 1, wherein the assembly includes a flat magnetic sheet which functions as a game board, such flat sheet functioning to allow users to place the "X" members and "O" members thereon for the purpose of playing the magnetic tic-tac-toe game.

9. The magnetic tic-tac-toe game assembly as described in claim 1, wherein the "O" members are manufactured in the size of three inches in diameter.

10. The magnetic tic-tac-toe game assembly as described in claim 1, wherein the "O" members each comprise a hole that is manufactured in the size of one and one-quarter inch in diameter.

11. The magnetic tic-tac-toe game assembly as described in claim 1, wherein the "X" members are manufactured in the size of three inches in width and three inches in length.

12. The magnetic tic-tac-toe game assembly as described in claim 1, wherein the elongated pliable members, "X" members, and "O" members are constructed as one thirty-second inch in thickness.

13. The magnetic tic-tac-toe game assembly as described in claim 1, wherein the elongated pliable members are twelve inches in length.

* * * * *